United States Patent [19]

Baum

[11] Patent Number: 4,834,341

[45] Date of Patent: May 30, 1989

[54] HOISTING APPARATUS

[75] Inventor: Leo A. Baum, Ratingen, Fed. Rep. of Germany

[73] Assignee: Putzer-Defries Winden- und Hebetechnik GmbH, Fed. Rep. of Germany

[21] Appl. No.: 69,858

[22] Filed: Jul. 6, 1987

[30] Foreign Application Priority Data

Jan. 29, 1987 [DE] Fed. Rep. of Germany ..... 3702651

[51] Int. Cl.[4] ..... B66D 1/14

[52] U.S. Cl. ..... 254/375; 254/342; 254/346; 254/372

[58] Field of Search ..... 254/352, 355, 356, 357, 254/372, 342, 376, 375, 346

[56] References Cited

U.S. PATENT DOCUMENTS

| | | | |
|---|---|---|---|
| 1,484,763 | 2/1924 | Ditson et al. | 254/356 X |
| 1,684,185 | 9/1928 | Kittredge | 254/356 X |
| 2,244,221 | 6/1941 | Schroeder | 254/356 |
| 3,047,114 | 7/1962 | Stevens | 254/352 X |
| 3,100,031 | 8/1963 | Lock | 254/352 X |

*Primary Examiner*—Stuart S. Levy
*Assistant Examiner*—Katherine Matecki
*Attorney, Agent, or Firm*—John F. A. Earley; John F. A. Earley, III

[57] ABSTRACT

A hoisting means comprises a rotary member for winding on or interlockingly guiding weight suspension means like a cable, a chain or similar means, drive means for the rotary member, first brake means for indirectly inducing a braking action onto the rotary member for suppressing a movement of the rotary member in the winding-off direction under influence of the load, and further comprises second brake means directly acting upon the rotary member.

17 Claims, 1 Drawing Sheet

HOISTING APPARATUS

BACKGROUND OF THE INVENTION

The present invention relates to a hoisting means comprising a rotary member for winding on or interlockingly guiding weight suspension means like a cable, a chain or similar means, further comprising drive means for said rotary member, further comprising first brake means for indirectly inducing a braking action onto said rotary member for suppressing a movement of said rotary member in the winding-off direction under influence of the load, as described, for example, in prospectus PD 142 "Spannzüge" of the company PÜTZER-DEFRIES Fördertechnik GmbH (1986). With such hoisting means like stretching or elevating hoists the first brake means improves the security of the hoisting means because it helps to avoid that the load runs out, in an uncontrolled fashion, which might at least cause damages on the load and which might present a hazard for persons present in the load area.

For various cases the security obtainable with the known hoisting means might be sufficient. For certain applications, however, it is required or mandatory, for example by safety regulations, to provide increased safety features.

SUMMARY OF THE INVENTION

It is, therefore, an object of the invention to advance the prior art hoisting means and to provide hoisting means which comply with increased safety requirements.

The invention is based on the finding that, for increasing the safety, it would not be sufficient, for example to provide an additional second brake means which, similar to the first brake means, only acts indirectly upon the rotary member, the movement of which finally has to be stopped safely. This results essentially from the fact, that a mere indirect action of the brake means upon the rotary member might cause troubles arising from load transmission members arranged in between the brake means and the rotary member, since, when under stress, these load transmission members may not fulfill their proper function, but may break instead, for example. In such a case the brake means is of no use, because the interlocking connection from the brake means to the rotary means is interrupted.

According to the present invention, these objects are solved by a hoisting means comprising a rotary member for winding on or interlockingly guiding weight suspension means like a cable, a chain or similar means, further comprising drive means for said rotary member, further comprising first brake means for indirectly inducing a braking action onto said rotary member for suppressing a movement of said rotary member in the winding-off direction under influence of the load, and comprising second brake means directly acting upon said rotary member.

By means of these surprisingly simple features now really an extraordinary high safety is achieved, because the influence of transmission members between a brake means and the rotary member is eliminated.

In this connection it is to be noted, that obviously the measures suggested according to the present invention, that is to let the second brake means act directly and immediately, may also be employed with hoisting means having a single brake means only.

According to a preferred embodiment of the invention the rotary member is formed as a chain sprocket; such chain sprocket transports a chain by means of interlocking engagement with the chain links, link by link, whereby in the region of the rotary member less space has to be provided than, for example, in a case where a cable is wound up, the windings of which remain on the rotary member. The chain may be formed, for example, as a roller chain or advantageously, as a link chain which is less rigid than a roller chain.

Advantageously the hoisting apparatus comprises a rotary member having a pivot, a locking wheel mounted on the pivot having a first face and a second face and a first brake disc mounted concentrically on the pivot adjcent to the first face of the locking wheel. Such an arrangement yields a particular space-saving, compact structure of the hoisting apparatus according to the present invention.

For increased safety the rotary member is advantageously formed as a single piece with the pivot, resulting in increased strength.

In order to provide a more uniform braking action and an enlarged brake area while maintaining a compact structure, it is advantageous to provide a second brake disc arranged in concentric relationship to the pivot at the second face of the locking wheel; thus, the locking wheel is acting upon on both sides during braking action. Advantageously, the brake discs are sintered brake discs made from a sintered material. This results in a uniform brake action which is maintained even after extended opperation.

The invention provides an arrangement where an actuating means is provided which interlockingly engages the pivot and is arranged concentrically to the pivot, where the actuating means acts upon the second brake means and moves, when the rotary member moves under the influence of the load, in an axial direction with respect to the rotary member and in the direction towards the locking wheel, and activates the brake action. For this purpose the pivot is advantageously provided with an outside thread and the actuating means is formed as a nut which at least partially surrounds the pivot and which has an inner thread shaped correspondingly to the outer thread. By appropriate shaping of the outside thread and the inside thread, respectively, an easy adaptation to prevailing load conditions can be achieved, while maintaining a compact structure of the entire hoisting apparatus.

Preferably the hoisting apparatus includes a cylinder gear with an external toothing, the cylinder gear being mounted on the pivot and a spur pinion having a toothing for engaging the external toothing of the cylinder gear, the spur pinion being drivable by the drive means. In this easy manner a gearing is provided the transmission ratio of which may easily be adapted by suitably choosing the toothed wheel work between spur pinion and cylinder gear. A particular space-saving structure is achieved by arranging the spur pinion in parallel relationship to the rotary member and connecting the space pinion axially apart from the toothed wheel work, to the first brake means.

In this section of the spur pinion the drive means advantageously engages the spur pinion. As a further safety device an overload clutch may be provided between the drive means and the spur pinion.

Advantageously the drive means comprises a hand lever which acts directly or indirectly via a ratchet means upon the rotary member in one direction of rotation, but which exerts no action on the rotary member in the opposite direction of rotation of the hand lever.

The first and/or the second brake means are subject to a certain wear. It is therefore advantageous if, during normal operation, when the safety features of the brake means are not required, a backwards rotation of the rotary member is prevented by other simple means. For this purpose it is suggested to provide the first and/or the second brake means with ratchet means each releasing the winding-on direction and blocking the winding-off direction. The safety is maintained even when the ratchet means breaks, because then the brake means is activated. A particular space-saving structure may be achieved if the ratchet means comprizes a ratchet arranged at the outer circumference of the locking wheel and if a spring-biased plunger pin, with the spring acting in a radial direction towards the locking wheel, engages the ratchet. The plunger pin is advantageously releasable for rewinding the rotary member without a load against the spring action.

The invention will subsequently be described in more detail in connection with a preferred embodiment and associated drawings depicting further advantages and features.

DETAILED DESCRIPTION

Figure 1:
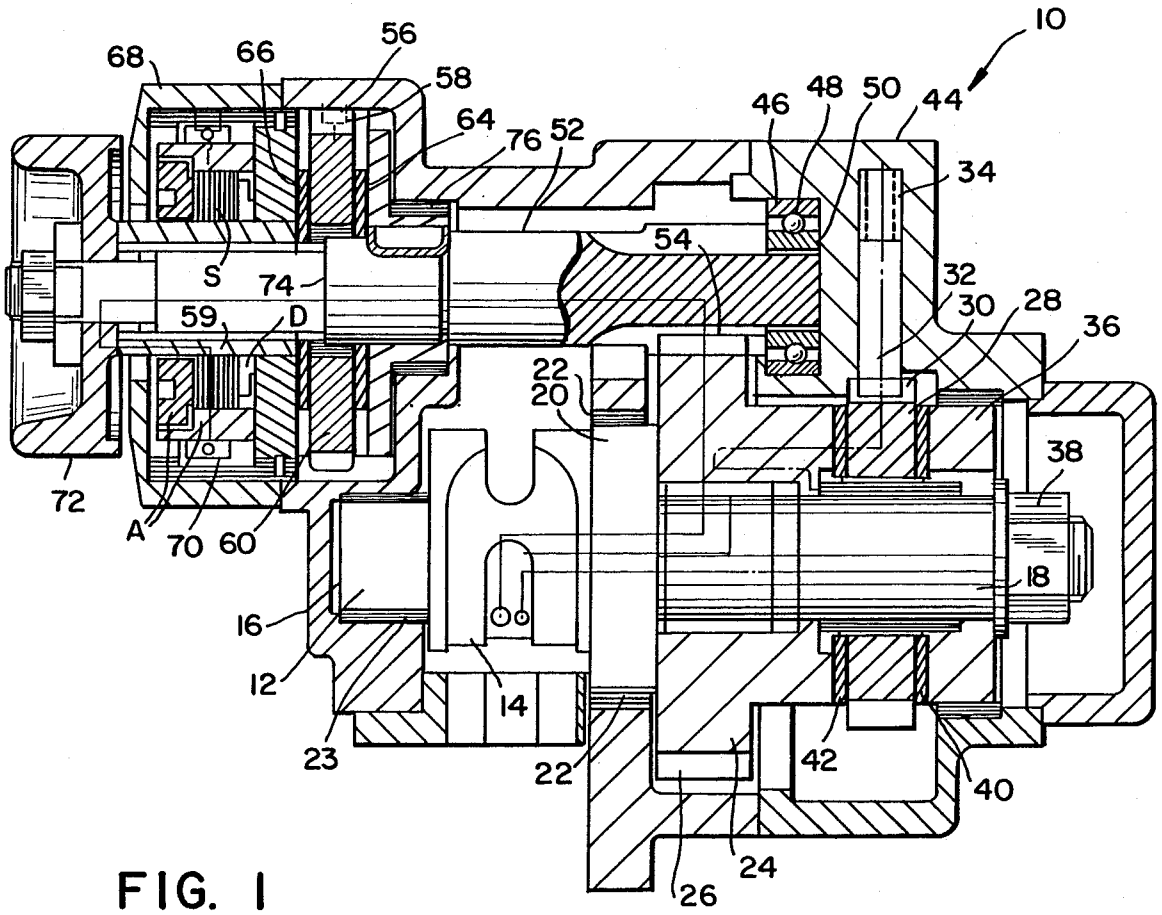
FIG. 1 shows a hoisting apparatus according to the present invention in a vertical cross section.

In FIG. 1 a hoisting apparatus according to the present invention is characterized, as a whole, by reference numeral 10. A rotary member is formed as a single-piece chain sprocket 12 having a short bearing neck 16, a chain receiving member 14 (the actual chain sprocket), and an adjacent bearing member 20 and a pivot or shaft 18 adjacent to the bearing member.

Chain sprocket 12 is received in a bearing bush 23, which is arranged in a section of the housing and surrounds bearing neck 16, and by a bearing bush 22 supporting bearing member 20.

On pivot 18 of chain sprocket 12 a concentrically aligned cylindrical gear 24 is provided which has protrusions in its central opening engaging with axially arranged grooves in pivot 18 and thus securing cylindrical gear 24 to pivot 18 against rotation. Obviously cylindrical gear 24 might be pinned to pivot 18 or be secured thereto in a different manner. On its outer circumference cylindrical gear 24 has a toothing adapted for engaging with a toothing 54 of a spur pinion 52 running parallel to chain sprocket 12.

Furthermore, a locking wheel 28 is arranged on pivot 18 in concentric relationship and secured to pivot 18. Locking wheel 28 has a ratchet 30 at its outer circumference into which a pin or plunger pin 32 arranged in a housing part 44 engages, and plunger pin is pushed into the direction towards locking wheel 28 by a spring 34 supported in housing part 44.

On both faces of locking wheel 28 sintered brake discs 40, 42 arranged in concentric relationship to pivot 18 are provided. For actuating these brake means comprising locking wheel 28 and brake discs 40, 42 a stop nut 36, 38 is provided which is arranged at the end section of pivot 18 and engages pivot 18 by means of an inner thread (nut 36) or an outer thread (pivot 18), respectively. If chain sprocket 12 and, therefore, pivot 18 turns in the "wrong" direction, that is under influence of a load, then the engagement of pivot 18 and stop nut 36, 38 by means of the threads leads to an axial movement of stop nut 36, 38 in the direction towards locking wheel 28. Because of this pressure load sintered brake disc 40 comes into braking contact with locking wheel 28 and stop nut 36, respectively, and sintered brake disc 42 comes into contact with cylindrical gear 24 and locking wheel 28. Thereby locking wheel 28 and pivot 18 secured thereto torsion-proof and thus the entire chain sprocket 12 is safely braked. Load transmission for hoisting the load is provided, as stated above, by toothed wheel work 54 of spur pinion 52 to toothed wheel work 26 of cylindrical gear 24 and thus to chain sprocket 12. Spur pinion 52 is received in its end section in a deep groove ball bearing sitting in housing part 44 and comprising an outer ball ring 46 and an inner ball ring 50 with balls 48 running therebetween. Furthermore, spur pinion 52 is received in another bearing bush 76 and is rotatable with respect to the housing.

In an end section 74 of spur pinion 52 a further brake means is provided comprising a locking wheel 60 with sintered brake discs 64, 66 on either side. Actuation of brake means 58, 64, 66 is performed by an actuation nut A axially moveable on spur pinion 52 and threadably engaged thereto. Locking wheel 60 is, similar to locking wheel 28 mentioned above, provided with a ratchet 58 at is outer circumference into which a pin or plunger pin 56 engages. Also plunger pin 56 may be released for rewinding under no load conditions.

Furthermore, in section 74 of spur pinion 52 an overload safety device 70 comprising multiple discs is provided. Overload safety device 70 is actuated by a hand lever 68; actuation of hand lever 68 leads to a rotation of spur pinion 52 in one direction of rotation only, whereas during actuation of hand lever 68 in the opposite direction spur pinion 52 stands still and hand lever 68 idles back. By means of a hand wheel 72 the transmission members may be released and thus running with no load of the chain for a hand-pull operation thereof may be achieved.

Any overload safety device, as known in the prior art, may be used. The overload safety device 70, as shown in the drawings, comprises a package of steel discs S arranged concentrically around a ring 59 mounted on section 74 of spur pinion 52 positioned between an adjusting nut A and a disc spring D. The steel discs S are pressed against the adjusting nut A by the disc spring D. With heavy loads, the friction between the different steel discs S due to being compressed together causes pinion 52 to lock. Hand lever 68 is used to activate safety device 70.

I claim:

1. A hoisting apparatus comprising a rotary member for guiding a weight suspension means like a cable, a chain or similar means, drive means for driving the rotary member, first brake means for indirectly inducing a braking action on the rotary member and for suppressing movement of the rotary member in a winding-off direction under influence of a load, second brake means for directly braking the rotary member, the rotary member having a pivot, a locking wheel mounted on the pivot having a first face and a second face, and a first brake disc mounted concentrically on the pivot adjacent to the first face of the locking wheel.

2. The hoisting apparatus of claim 1, the rotary member being a single piece with the pivot.

3. The hoisting apparatus of claim 1, further including
a second brake disc mounted concentrically on the pivot adjacent to the second face of the locking wheel.

4. The hoisting apparatus of claim 3, the first and second brake discs being sintered brake discs.

5. The hoisting apparatus of claim 3, the first brake disc being a sintered brake disc.

6. The hoisting apparatus of claim 1, further including actuating means arranged concentrically around the pivot for activating braking action on the second brake means, said actuating means including means for moving in an axial direction with respect to the rotary member and in a direction towards the locking wheel when the rotary member moves under the influence of a load for activating the braking action.

7. A hoisting apparatus as claimed in claim 6, said pivot (18) being provided with an outside, thread and said actuating means (36, 38) being formed as a nut which at least partially surrounds said pivot (18) and has an inner thread shaped correspondingly to said outside thread.

8. The hoisting apparatus of claim 1, further including
a cylinder gear with an external toothing,
the cylinder gear being mounted on the pivot, and
a spur pinion having a toothing for engaging the external toothing of the cylinder gear,
the spur pinion being drivable by the drive means.

9. A hoisting apparatus as claimed in claim 8, said spur pinion (52) being parallel to said rotary member (12-20).

10. A hoisting apparatus as claimed in claim 8, said spur pinion (52) being connected axially apart from said toothing to said first brake means (60, 64, 66).

11. The hoisting apparatus of claim 10, further including
an overload clutch (70) that is provided between said drive means (68) and said spur pinion (52).

12. The hoisting apparatus of claim 1, said drive means comprising a hand lever (68) acting, via a ratchet means, upon said rotary member (12-20).

13. A hoisting apparatus as claimed in claim 1, said first (60, 64, 66) and said second brake means (28, 40, 42) being provided with ratchet means (58, 30) releasing the winding-on direction and blocking the winding-off direction.

14. The hoisting apparatus as claimed in claim 13,
said ratchet means including a ratchet (58, 30) arranged at the outer circumference of said locking wheel (60, 28), and
a spring-biased plunger pin (56, 32), and
a spring acting on the plunger pin (56,32) in a radial direction towards said locking wheel (60, 28) engaging the plunger pin (56, 32) with said ratchet.

15. A hoisting apparatus as claimed in claim 14, said plunger pin (56, 32) being releasable, against the spring action, for rewinding said rotary member (12-20) without a load.

16. The hoisting means of claim 13, said first (60, 64, 66) being provided with ratchet means (58, 30) releasing the winding-on direction and blocking the winding-off direction.

17. A hoisting apparatus comprising
a rotary member for guiding a weight suspension means like a cable, a chain or similar means,
drive means for driving the rotary member,
first brake means for indirectly inducing a braking action on the rotary member and for suppressing movement of the rotary member in a winding-off direction under influence of a load,
second brake means for directly braking the rotary member,
said rotary member (12-20) being a chain sprocket (12),
the rotary member having a pivot,
a locking wheel mounted on the pivot having a first face and a second face, and
a first brake disc mounted concentrically on the pivot adjacent to the first face of the locking wheel,
said rotary member (12-20) being a single piece with said pivot (18),
a second brake disc mounted concentrically on the pivot adjacent to the second face of the locking wheel,
the first and second brake discs being sintered brake discs,
actuating means arranged concentrically around the pivot for activating braking action on the second brake means, said actuating means including means for moving in an axial direction with respect to the rotary member and in a direction towards the locking wheel when the rotary member moves under the influence of a load for activating the braking action,
said pivot being provided with an outside thread and said actuating means (36, 38) being formed as a nut which at least partially surrounds said pivot (18) and has an inner thread shaped correspondingly to said outside thread,
a cylinder gear with an external toothing, the cylinder gear being mounted on the pivot, and
a spur pinion having a toothing for engaging the external toothing of the cylinder gear,
the spur pinion being drivable by the drive means,
said spur pinion (52) being parallel to said rotary member (12-20),
said spur pinion being connected axially apart from said toothing to said first brake means,
an overload clutch (70) that is provided between said drive means (68) and said spur pinion (52),
said drive means comprising a hand lever (68) acting, via a ratchet means, upon said rotary member (12-20),
said first (60, 64, 66) brake means (28, 40, 42) being provided with ratchet means (58, 30) releasing the winding-on direction and blocking the winding-off direction,
said ratchet means including a ratchet (58, 30) arranged at the outer circumference of said locking wheel (60, 28), and
a spring-biased plunger pin (56, 32), and
a spring acting on the plunger pin (56, 32) in a radial direction towards said locking wheel (60, 28) engaging the plunger pin (56, 32) with said ratchet,
said plunger pin (56, 32) being releasable, against the spring action, for rewinding said rotary member (12-20) without a load.

* * * * *